US005477110A

United States Patent [19]

Smith et al.

[11] Patent Number: 5,477,110

[45] Date of Patent: Dec. 19, 1995

[54] METHOD OF CONTROLLING A FIELD EMISSION DEVICE

[75] Inventors: Robert T. Smith, Mesa; Dean Barker, Tempe, both of Ariz.

[73] Assignee: Motorola, Schaumburg, Ill.

[21] Appl. No.: 268,987

[22] Filed: Jun. 30, 1994

[51] Int. Cl.[6] ..... G09G 3/10

[52] U.S. Cl. ..... 315/169.3; 315/169.4; 381/29; 381/35; 348/398

[58] Field of Search ..... 315/169.4, 169.3, 315/349; 348/398; 381/29, 31, 34, 35

[56] References Cited

U.S. PATENT DOCUMENTS

| | | | |
|---|---|---|---|
| 4,455,649 | 6/1984 | Esteban et al. | 381/29 X |
| 5,075,596 | 12/1991 | Young et al. | 315/169.3 |
| 5,075,683 | 12/1991 | Ghis | 340/793 |
| 5,115,309 | 5/1992 | Hang | 348/398 X |
| 5,157,309 | 10/1992 | Parker et al. | 315/169.1 |
| 5,191,217 | 3/1993 | Kane et al. | 315/169.1 X |
| 5,262,698 | 11/1993 | Dunham | 315/169.1 |
| 5,337,085 | 8/1994 | Lee et al. | 348/398 |
| 5,382,979 | 1/1995 | Mun | 348/398 |
| 5,387,844 | 2/1995 | Browning | 315/169.3 |

*Primary Examiner*—Robert J. Pascal
*Assistant Examiner*—Haissa Philogene
*Attorney, Agent, or Firm*—Robert F. Hightower

[57] ABSTRACT

A digital video word (14) that is utilized to specify an image to be displayed by a field emission device is divided into a plurality of digital subwords (16, 17). Each digital subword (16, 17) is utilized to create a control signal (21, 22) that is applied to an input (23, 26, 32, 33) of a drive source (24, 27, 31). The digital subwords (16, 17) divide the control signals (21, 22) into time slots wherein each time slot has a duration that is greater than the duration of time slots represented by the original digital video word (14). In response to the control signals (21, 22) the drive source (24, 27, 31) provides a drive signal (28, 34) that has an output value and duration that is controlled by the duration of the control signals, and by an active and inactive state encoded by the control signals.

20 Claims, 6 Drawing Sheets

METHOD OF CONTROLLING A FIELD EMISSION DEVICE

BACKGROUND OF THE INVENTION

The present invention relates, in general, to schemes for controlling display devices, and more particularly to a novel scheme for controlling drive signals for display devices.

Field emission devices (FEDs) are well known in the art and are commonly employed for a broad range of applications including image display devices. An example of a field emission device (FED) is described in U.S. Pat. No. 5,191,217 issued to Kane et al. on Mar. 2, 1993. One prior method of controlling such FEDs, commonly referred to as pulse width modulation, utilizes a digital video word to encode the intensity of an image that is to be displayed by the FED during a particular display time. The value of the digital word represents a portion of the total display time that a fixed drive voltage is applied to the FED or the FED active time. One problem with such prior control methods is the resolution that can be obtained. Because the FED appears to a drive circuit as a large capacitor, the drive signal has a large rise time and fall time. Consequently, the rise time and fall time can represent a large portion of the FED active time. For low intensity signals, the rise time and the fall time may be greater than the total FED active time. For example, for an eight-bit video word the minimum display time may be ten nanoseconds which typically is less than the rise time required to drive a FED. Consequently, no image would be displayed.

Another method, commonly referred to as amplitude modulation, varies the voltage value applied to each pixel to control the intensity. Because of the resulting low drive voltage increments, the method is susceptible to noise which results in a loss of display quality.

Accordingly, it is desirable to have an FED control method that has a minimum FED active time which is greater than the minimum time increments represented by the digital video word, that does not have a single or fixed drive signal, that has a minimum time increment that is greater than the rise and fall time of the drive signal of the FED, and that maximizes the minimum voltage drive increments applied to the FED.

DETAILED DESCRIPTION OF THE DRAWINGS

Figure 1:
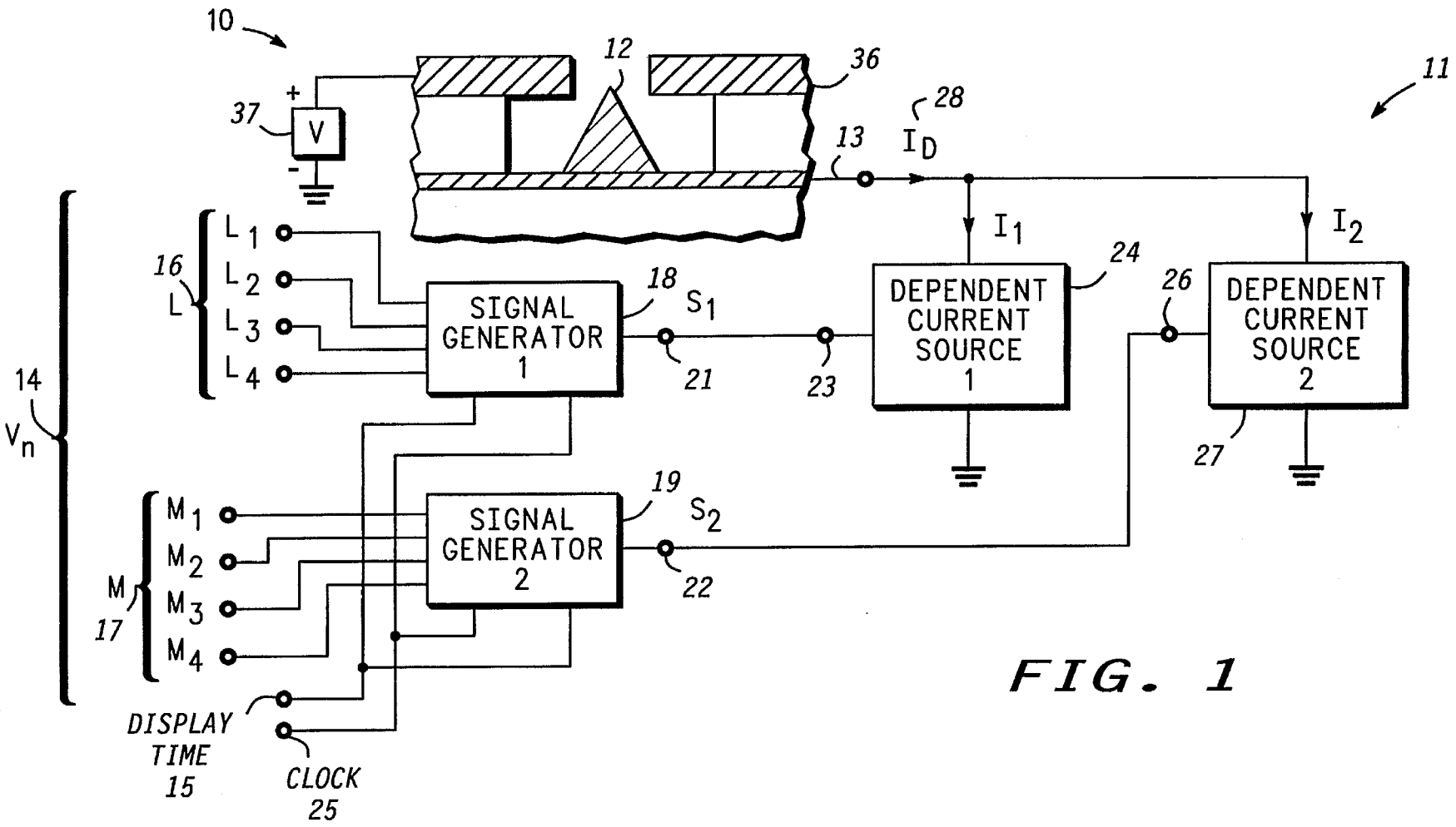
FIG. 1 schematically illustrates an embodiment of a field emission device control apparatus in accordance with the present invention.

FIG. 1 schematically illustrates a control apparatus or control circuit 11 suitable for driving a field emission device (FED) 10. For simplicity of the explanation, only a portion of the FED is shown, however it is understood that FED 10 has other elements as described in U.S. Pat. No. 5,191,217 issued to Kane et al. on Mar. 2, 1993. A cold-cathode emitter or cathode 12 emits electrons in response to a signal applied to a drive signal input 13 of FED 10. Typically, a voltage source 37 is applied to an extraction grid 36 of FED 10 in order to facilitate emitting electrons from emitter 12. The electrons emitted from cathode 12 form an image on an anode (not shown) of FED 10. Although FIG. 1 illustrates circuit 11 driving cathode 12, it is understood that circuit 11 can drive other elements, such as extraction grid 36.

Circuit 11 receives a digital control word or video word 14 from external circuitry (not shown). As shown in FIG. 1, word 14 is represented by the symbol $V_n$ where n is the number of bits in the video word. The preferred embodiment shown in FIG. 1 utilizes eight bits for word 14, however, it is understood that word 14 may have any number of bits. Circuit 11 divides word 14 into a plurality of digital subwords each of which is converted into a control signal for controlling the signal applied to input 13. In the embodiment shown in FIG. 1, word 14 is divided into two subwords represented by a most significant subword or nibble 17 and a least significant subword or nibble 16. As shown in FIG. 1, nibble 16 is labeled as L, and has four individual bits $L_1$, $L_2$, $L_3$, and $L_4$. Also, nibble 17 is labeled as M, and has four corresponding bits $M_1$, $M_2$, $M_3$, and $M_4$. Word 14, and nibbles 16 and 17 are presented to circuit 11 for a period of time typically referred to as a line time or display time. The display time is dependent upon the refresh or scan rate of the display in addition to the number of horizontal lines of the display. For example, a display typically is implemented as a number of rows and columns of FEDs that are scanned or refreshed at a sixty Hertz (60 Hz) rate. The corresponding display time for an FED display having a typical format, e.g. a monochrome VGA format, is approximately 35 microseconds.

Circuit 11 includes a first signal generator 18 that has a number of inputs corresponding to the number of bits in nibble 16. In the embodiment shown in FIG. 1, generator 18 has four inputs for receiving nibble 16. Generator 18 also receives a display time signal 15 and a clock 25. Signal 15 and clock 25 are utilized as timing signals within generator 18, as will be seen hereinafter. Display time signal 15 is active during the display portion of a cycle. Clock 25 oscillates at a rate equal to one divided by the display time (1/display time) times the maximum possible decimal value of either nibble 16 or 17. Consequently, generator 18 divides the display time into the maximum number of increments that can be encoded by the number of bits in nibble 16. For the embodiment shown in FIG. 1, nibble 16 has four bits, thus, generator 18 divides the display time into $2^4$ or sixteen time increments. These increments are commonly referred to as time slot 0 through time slot 15. Generator 18 develops an output or control signal 21 ($S_1$) that is utilized to control the drive signal applied to input 13. Generator 18 activates signal 21 for the number of time slots encoded by nibble 16. However, in the preferred embodiment, signal 21 is always inactive during the last time slot or time slot fifteen. In other embodiments it is to be understood that signal 21 could remain active during all time slots. Similarly, a second signal generator 19 has a number of inputs corresponding to the number of bits in nibble 17. As shown in the embodiment of FIG. 1, generator 19 has four inputs for receiving nibble 17. Generator 19 also receives signal 15 and clock 25 in order to create an output or control signal 22 ($S_2$) that is utilized to control the drive signal applied to input 13. Signal 22 is active for the number of time slots encoded in nibble 17, e.g. 16 time slots for the embodiment shown in the FIG. 1. Accordingly, generators 18 and 19 create signals 21 and 22, respectively, each having an active time that is responsive to the value of nibbles 16 and 17 respectively. In the preferred embodiment, signals 21 and 22 are always inactive during time slot 15, so the maximum time cathode 12 can be active is 15/16 of the total display time. However, as indicated hereinbefore, in other embodiments signals 21 and 22 may be active during all time slots.

Figure 2:
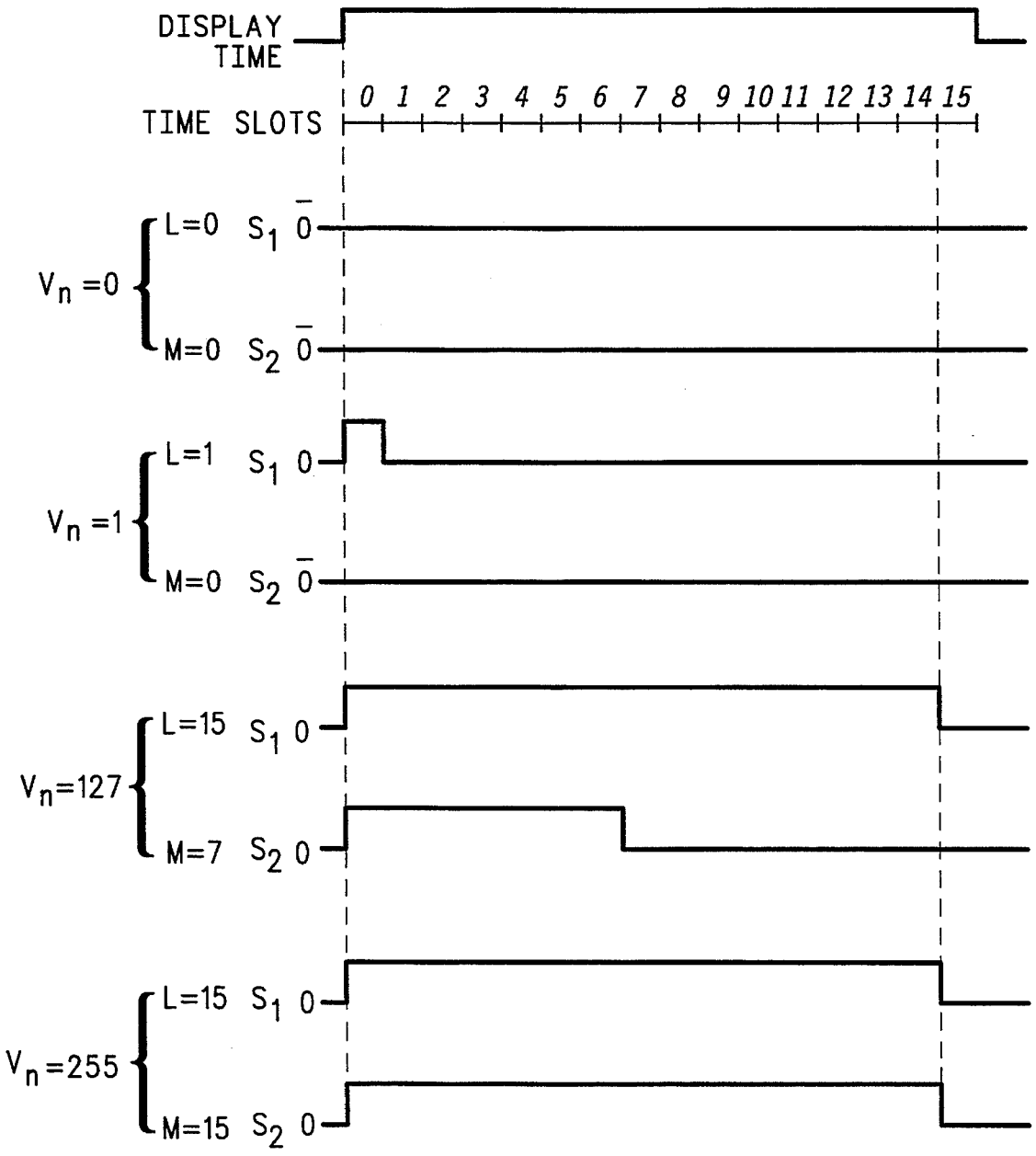
FIG. 2 is a graph illustrating some operational characteristics of the control apparatus of FIG. 1 in accordance with the present invention.

By way of example, FIG. 2 is a graph illustrating the status of control signals 21 and 22, as shown in the embodiment of FIG. 1, for various values of word 14. The following description contains references to both FIG. 1 and FIG. 2. The Time Slot and Display Time plots are shown for reference. The Display Time plot illustrates the maximum time that an FED may be active. The Time Slot plot indicates the time slots that the Display Time is divided into by each cycle of clock 25. The first plot of FIG. 2 illustrates the conditions of signals 21 and 22, $S_1$ and $S_2$, when word 14 ($V_N$) has a decimal value of zero. For this condition, both nibble 16 (L) and nibble 17 (M) also have a decimal value of zero. Consequently, signals 21 ($S_1$) and 22 ($S_2$) are inactive. The second plot in FIG. 2 illustrates the conditions when word 14 has a decimal value of one. Nibble 16 has a decimal value of one and nibble 17 has a zero value. Consequently, signal $S_1$ becomes active during time slot zero and is inactive for all other time slots, and signal $S_2$ is inactive for all time slots. When word 14 has a decimal value of one hundred twenty-seven, nibble 16 has a value of fifteen and nibble 17 has a decimal value of seven as shown by plot three of FIG. 2. Accordingly, signal 21 ($S_1$) is active during time slots zero through fourteen, and signal 22 ($S_2$) is active during time slots zero through six. As shown by plot 4 of FIG. 2, word 14 has the maximum value of two hundred fifty-five, thus, nibble 16 (L) has a value of fifteen and nibble 17 (M) also has a value of fifteen. Consequently, both signals 21 and 22 ($S_1$ and $S_2$) are active during time slots zero through fourteen.

Figure 3:
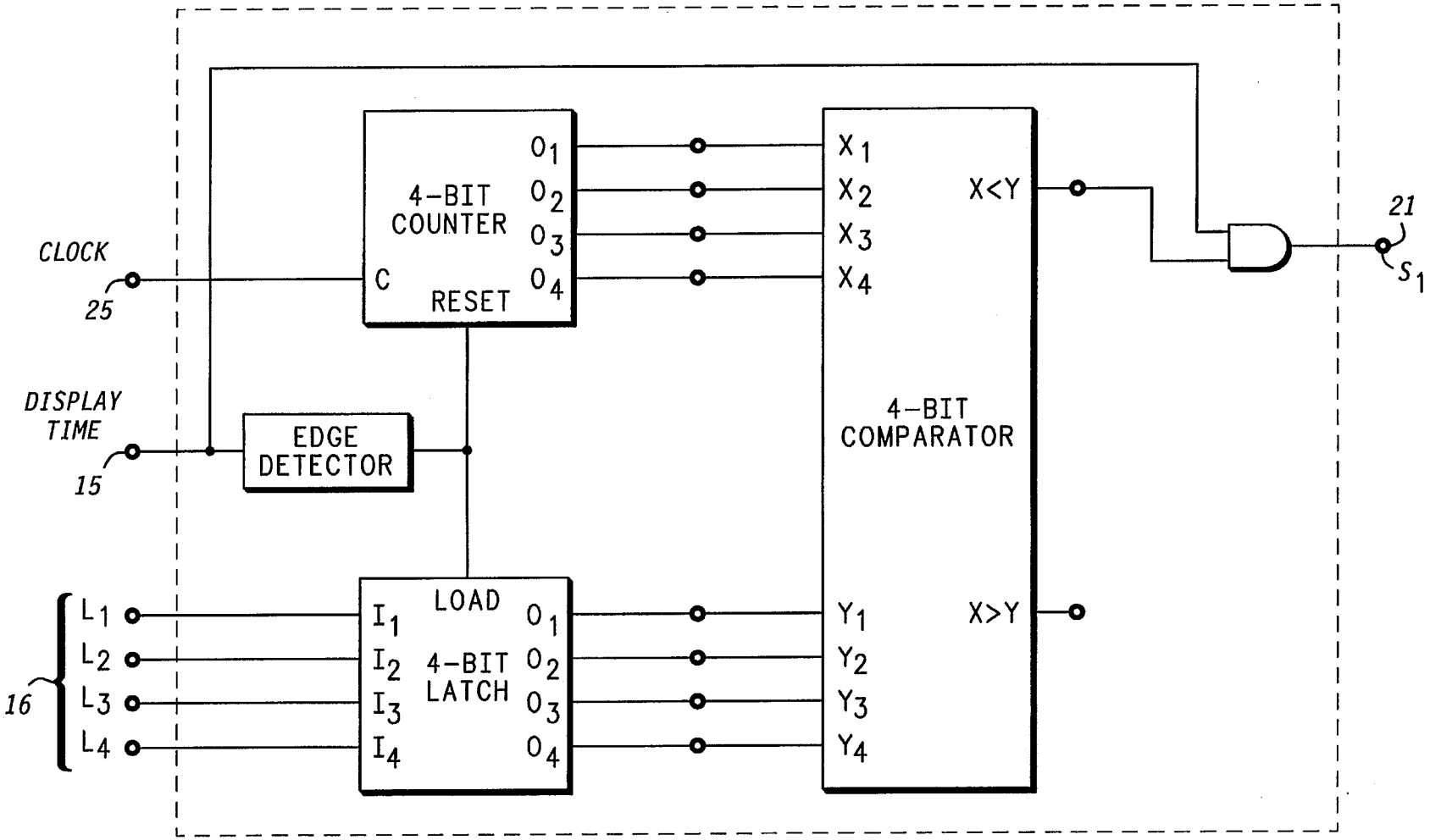
FIG. 3 schematically illustrates an embodiment of a portion of the control apparatus of FIG. 1.

FIG. 3 schematically illustrates an embodiment of generator 18 of FIG. 1. As shown in FIG. 3, generator 18 is implemented to receive a four-bit nibble, however, it is understood that the implementation is expandable to other subwords having more bits. Display time signal 15 is presented to an edge detector that develops a short load pulse at the positive edge of signal 15. The pulse is presented to a four bit latch where the pulse is utilized to load nibble 16 into the latch. A four-bit counter receives the pulse as a reset pulse to clear the counter to zero at the beginning of the Display Time interval. Clock 25 is connected to a clock input of the counter in order to increment the counter value at each time slot time starting at the beginning of time slot one. The output of the counter and the output of the latch are received by the X and Y, respectively, inputs of a four-bit comparator that compares the value of the latch output to the value of the counter output. Signal is generated by logically "ANDing" display time 15 with the x<y output of the comparator. Referring back to FIG. 1, signals 21 and 22 are utilized to control a drive current ($I_D$) or drive signal 28 that drives emitter 12. Signal 28 is formed by combining the output of a first dependent current source 24 and a second dependent current source 27. Sources 24 and 27 are connected in parallel so that an output current $I_1$ from source 24 plus an output current $I_2$ from source 27 form signal 28. Control signal 21 is coupled to an input 23 of source 24 so that source 24 is active when signal 21 is active. Similarly, control signal 22 is coupled to an input 26 of source 27 so that 27 is active when signal 22 is active.

The values of currents $I_1$ and $I_2$ are determined by equating the charge emitted by each current $I_1$ and $I_2$ to the desired maximum charge to be emitted by emitter 12 as shown by the equation:

$$I_m \frac{T_L}{2^n} D_v = I_1 \frac{T_L}{2^{n/2}} D_L + I_2 \frac{T_L}{2^{n/2}} D_M$$

where;

$I_m$= maximum current to provide maximum intensity when a drive current is supplied to the FED for $(2_{n-1})/(2^n)$ times the entire display time (e.g. for an 8-bit word $I_m$ is supplied for 255/256 times the entire display time), TL= total display time, n= number of bits in the video word, $D_v$= decimal value of the video word, $D_M$= decimal value of the most significant nibble, and $D_L$= decimal value of the least significant nibble.

Simplifying the equation for n=8 yields:

$$I_m \frac{T_L}{2^8} D_v = I_1 \frac{T_L}{2^4} D_L + I_2 \frac{T_L}{2^4} D_M$$

$$\frac{I_m}{256} D_v = \frac{I_1}{16} D_L + \frac{I_2}{16} D_M$$

$$\frac{I_m}{16} D_v = \frac{I_1}{1} D_L + \frac{I_2}{1} D_M$$

Solving the equation for $I_1$ in terms of $I_m$ at a digital word 14 value of one yields:

$$@\ V=1;\ \frac{I_m}{16}\ 1 = \frac{I_1}{1}\ 1 + \frac{I_2}{1}\ 0$$

$$\text{thus, } I_1 = \frac{I_m}{16}.$$

Substituting this $I_1$ value into the equation and solving for $I_2$ in terms of $I_m$ yields:

$$\frac{I_m}{16} D_v = \frac{I_1}{1} D_L + \frac{I_2}{1} D_M$$

$$\frac{I_m}{16} D_v = \frac{I_m D_L}{16} + \frac{I_2}{1} D_M$$

Solving the equation at the maximum value of word 14 yields:

$$\frac{I_m}{16}\ 255 = \frac{I_{m15}}{16} + \frac{I_2}{1}\ 15$$

$$I_m \frac{255}{16} - \frac{I_{m15}}{16} = 15 I_2$$

$$I_m \frac{240}{16} = 15 I_2$$

$$I_2 = I_m \frac{16}{16}$$

-continued thus, $I_2 = I_m$.

The equations show that $I_2$ is equal to $I_m$ and $I_1$ is equal to $1/16\ I_m$. It should be noted, that $I_m$ is the maximum current value when using a single current source and the current is applied during $(2^{n-1})/(2^n)$ times of the entire display time or line time. As shown by FIG. 2, signals 21 and 22 are always zero during time slot fifteen, therefore, sources 23 and 27 are not active for the entire display time. However, the equations result in values for $I_1$ and $I_2$ that when applied for $15/16$ time slots provide the same maximum intensity as $I_m$ applied for $255/256$ of the Display Time. The value of $I_m$ is determined by developing a current versus intensity characteristic curve for the type of FED to be driven by circuit 11. Techniques to develop such curves are well known to those skilled in the art.

The above equations are based on using two current sources and $\sqrt{2^N}$ time slots, where N is the video word length. Any number of current sources and corresponding time slots can be used, i.e., X number of current sources can be used with $\sqrt[X]{2^N}$ time slots.

Sources 24 and 27 can be implemented by a variety of techniques that are well known to those skilled in the art. For example, source 24 can be an NPN transistor with a base connected to input 23, a collector connected to input 13, and a base coupled to ground through a resistor of value R1. Source 27 can be an NPN transistor having a base connected to input 26, a collector connected to input 13, and an emitter coupled to ground through a resistor having a value that is $1/16$ the value of resistor R1.

Figure 4:
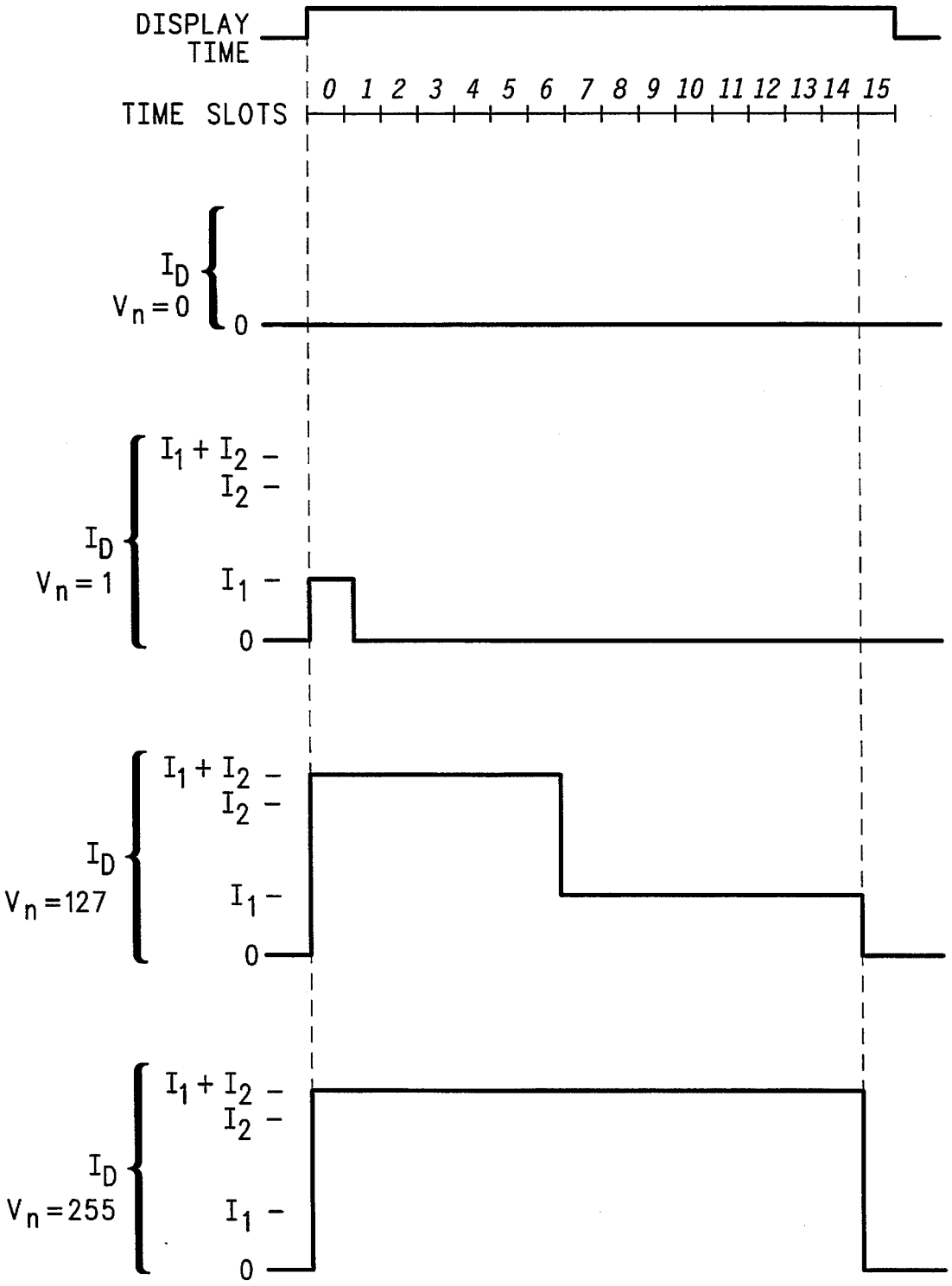
FIG. 4 is a graph illustrating further operational characteristics of the control apparatus of FIG. 1.

FIG. 4 is a graph illustrating the operational status of drive current 28 (FIG. 1) for four different values of video word 14. The four different operating conditions correspond to the conditions of signals 21 and 22 illustrated in FIG. 2. The Display Time and the Time Slots are shown for reference as explained in FIG. 2. The first plot of FIG. 4 illustrates drive current 28 ($I_D$) when word 14 has a decimal value of zero. Under these conditions, current 28 ($I_D$) is also zero. When video word 14 has a decimal value of one, control signal 21 enables source 24 to be active during time slot zero as shown by plot 2. Since source 24 is active, $I_D$ has a value of $I_1$ or $1/16\ I_m$. Plot 3 indicates the conditions when video word 14 has a value of one hundred twenty-seven. For such conditions, control signals 21 and 22 enable both sources 24 and 27 so that source 24 is active during time slots zero through six while source 27 is active during time slots zero through fourteen. Consequently the value of $I_D$ is $17/16\ I_m$ during time slots zero through six, and equal to $I_m$ during time slots seven through fourteen. When video word 14 has a value of two hundred fifty-five, control signals 21 and 22 activate both sources 24 and 27 during time slots zero through fourteen as shown by plot 4 of FIG. 4.

Figure 5:
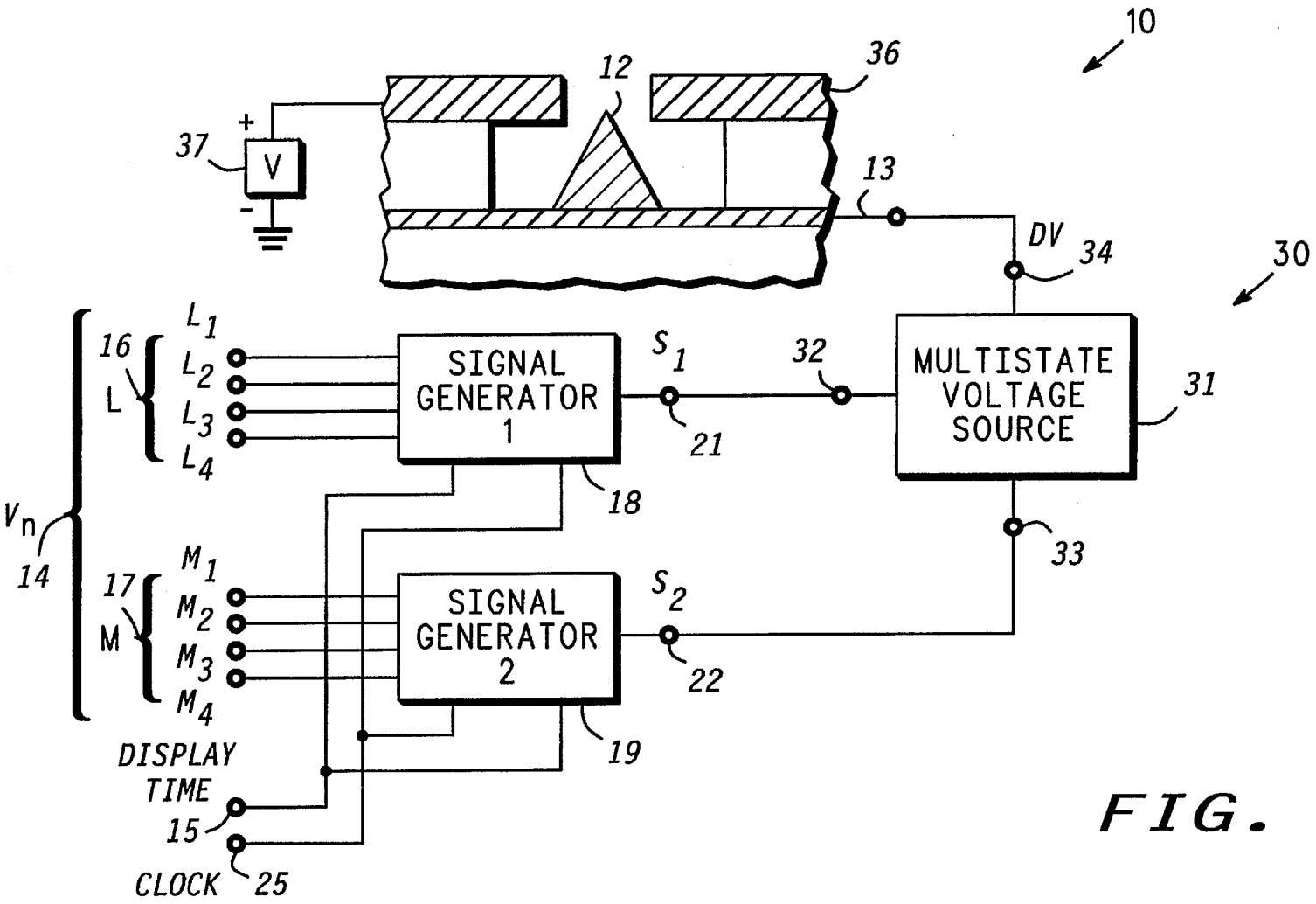
FIG. 5 schematically illustrates another embodiment of an FED control apparatus in accordance with the present invention.

FIG. 5 illustrates another embodiment of a field emission device (FED) control apparatus or control circuit 30. Elements of FIG. 5 that are the same as FIG. 1 have the same reference numerals. The embodiment illustrated in FIG. 5 utilizes various voltages to drive FED 10. A dependent multistate voltage source 31 has an output drive signal or drive voltage (DV) 34 that it is utilized to drive emitter 12 of FED 10. Consequently, the output of source 31 is connected to input 13. Because the electron emission is controlled by the differential voltage between cathode 12 and grid 36, signal 34 must have a high voltage when signal 34 is inactive and a low voltage when signal 34 is active.

The value of voltage 34 is determined by the digital word encoded on inputs 32 and 33 of source 31. That is, the active or inactive state of signals 21 and 22 function as an encoded control word that selects one of four different output voltage values for source 31. Consequently, an input 32 of source 31 is connected to signal 21, and input 33 of source 31 is connected to signal 22. The four different voltage values typically are selected to correspond to the display intensity provided by each of the four different current values used for drive current 28 shown in FIG. 1 and FIG. 4. The four different voltage values typically are determined by experimentation. A typical FED is selected, and various voltages are applied until four voltages are found that provide the same four different intensity levels as the four drive currents utilized in FIG. 1. For example, one particular FED has drive currents of approximately 0.0, 6 micro-amps, 100 micro-amps, and 106 micro-amps. Corresponding values of drive voltage 34 that provide the same display intensity as these current values are approximately 100 volts, 50 volts, 33 volts, and 30 volts, respectively. The large voltage change (100 volts to 50 volts) required to obtain a differential current between 0 and 6 micro-amps values compared to the small voltage change (33 volts to 30 volts) required to provide a current differential between 100 and 106 micro-amps indicates the nonlinear relationship between the display intensity and the voltage required to drive the FED.

Source 31 can be implemented by many different circuit techniques that are well known in the art. For example, source 14 can be an analog-to-digital converter that has resistor values selected to provide the desired voltage outputs.

Figure 6:
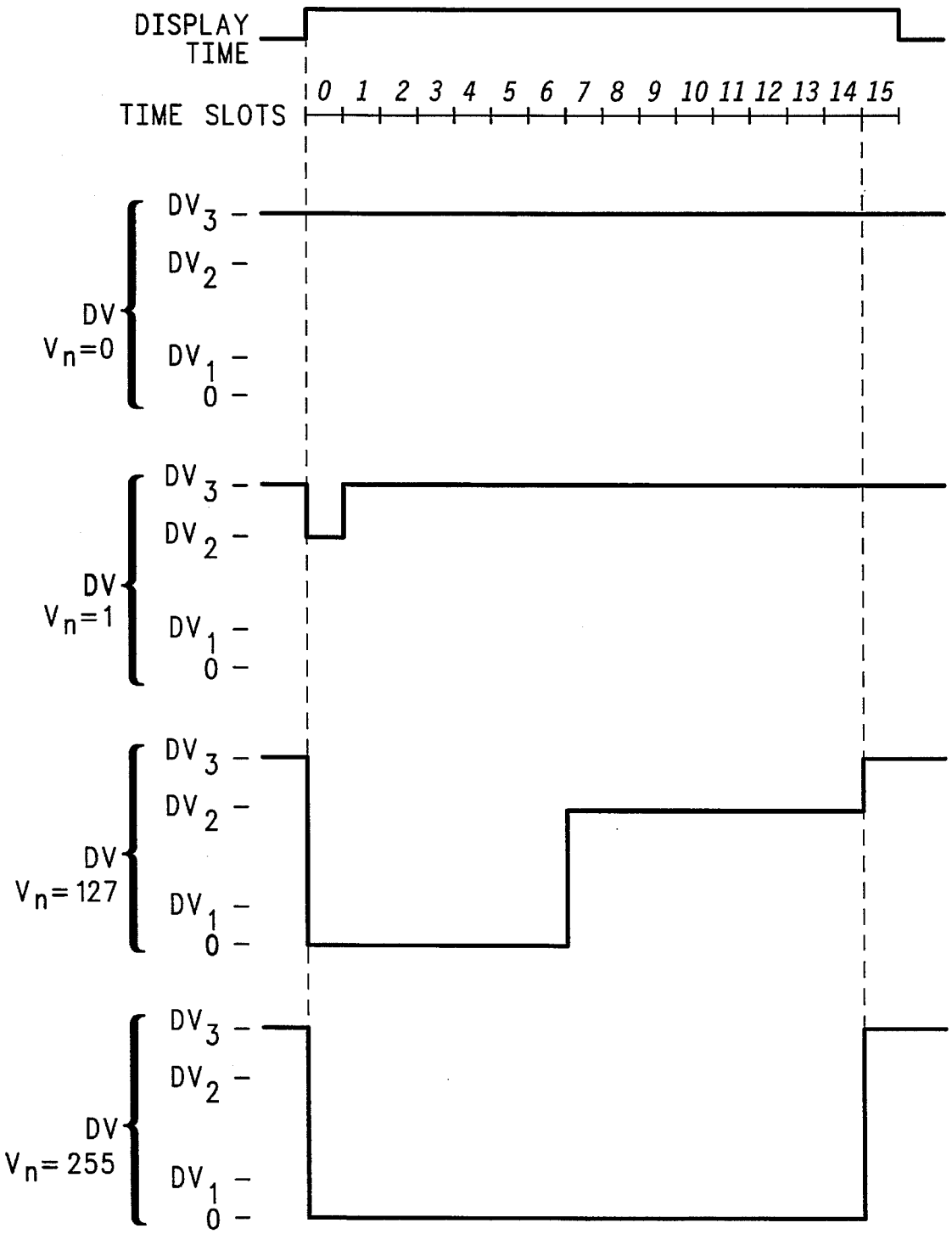
FIG. 6 is a graph illustrating some operational characteristics of the control apparatus of FIG. 5 in accordance with the present invention.

FIG. 6 is a graph illustrating various operational conditions of voltage 34 for various values of video word 14 shown in FIG. 6. When video word 14 has a zero value, source 31 is inactive and has a high voltage output value as indicated by plot 1 of FIG. 6 and results in zero current through FED 10. For a word 14 value of one, control signals 21 and 22 enable voltage source 31 to output a voltage corresponding to the lowest differential voltage during time slot zero as illustrated by plot 2 of FIG. 6. This results in a current of approximately $I_M/16$ through FED 10 during time slot zero. Plot 3 illustrates the conditions when word 14 has a value of one hundred twenty-seven. Control signals 21 and 22 enable source 31 to provide a minimum drive voltage corresponding to the highest differential voltage during time slots zero through six and an intermediate voltage corresponding to an intermediate differential voltage during time slots seven through fourteen. The resulting current through FED 10 is approximately $(17/16)I_M$ for time slots zero through six, and $I_M/16$ for time slots seven through fourteen. For a video word 14 having a value of two hundred fifty-five, control signals 21 and 22 enable source 31 to provide the minimum drive voltage corresponding to the highest differential voltage during time slots zero through fourteen. The resulting current is approximately $17/16\ I_M$ for time slots zero through fourteen.

Although the descriptions of FIG. 1 through FIG. 6 are based on a cold-cathode field emission device for image displays, the descriptions are applicable to other cold-cathode field emission devices and other cold-cathode devices as well as other electron sources and optical devices including light emitting diodes.

By now it should be appreciated that there has been provided a novel method of controlling field emission devices. By dividing the digital video word into a plurality of subwords the number of time slots in a display time is reduced. Consequently, one time slot is greater than the rise and fall time of the drive signal, thus, the rise and fall times become a minor portion of any display time slot resulting in better control of the display image. Utilizing multiple drive sources results in greater control over the drive signal applied to the FED and results in improved accuracy in the displayed image. Additionally, reducing the clock rate from the higher clock rate of prior circuits results in lower drive circuit power dissipation.

We claim:

1. A method of controlling a field emission device comprising:

receiving a digital video word;

dividing the video word into a plurality of digital subwords;

converting each subword into a control signal thereby forming a plurality of control signals, each control signal having an active time; and utilizing the plurality of control signals to control a drive signal applied to the field emission device wherein an active time of the drive signal and a value of the drive signal are responsive to the plurality of control signals.

2. A method of controlling a field emission device comprising:

receiving a digital video word;

dividing the video word into a plurality of digital subwords:

converting each subword into a control signal thereby forming a plurality of control signals, each control signal having an active time; and utilizing the plurality of control signals to control a drive signal applied to the field emission device by using an active state and an inactive state of the plurality of control signals to encode the value of the drive signal wherein an active time of the drive signal and a value of the drive signal are responsive to the plurality of control signals.

3. The method of claim 2 wherein utilizing the plurality of control signals to control the drive signal includes utilizing a value of a first digital subword of the plurality of digital subwords to determine an active time of a first control signal, and a value of a second digital subword of the plurality of digital subwords to determine an active time of a second control signal.

4. The method of claim 2 wherein utilizing the plurality of control signals to control the drive signal includes applying each control signal to a multistate voltage source to control both an output voltage value of the multistate voltage source and an active time of the output voltage value.

5. The method of claim 4 further including having the output voltage value responsive to a digital word encoded by an active and inactive state of the plurality of control signals.

6. The method of claim 5 further including changing the output voltage value as the active time of each control signal terminates.

7. The method of claim 2 wherein utilizing the plurality of control signals to control the drive signal includes applying the plurality of control signals to a plurality of current sources responsive to the plurality of control signals; and coupling the plurality of current sources in parallel so that an output from the plurality of current sources forms the drive signal.

8. The method of claim 7 wherein applying the plurality of control signals to the plurality of current sources responsive to the plurality of control signals includes applying a first control signal of the plurality of control signals to a first current source having a first current output, and applying a second control signal of the plurality of control signals to a second current source having a second current output.

9. The method of claim 8 further including having an active time of the first current source approximately equal to an active time of the first control signal, and an active time of the second current source approximately equal to an active time of the second control signal.

10. The method of claim 2 wherein dividing the video word into a plurality of digital subwords includes dividing an 8-bit video word into a first nibble and a second nibble.

11. The method of claim 10 wherein converting each subword into the control signal includes utilizing a value of the first nibble to determine an active time of a first control signal of the plurality of control signals, and a value of the second nibble to determine an active time of a second control signal of the plurality of control signals.

12. The method of claim 11 wherein utilizing the plurality of control signals to control the drive signal includes applying the first control signal to a first input of a multistate voltage source and the second control signal to a second input of the multistate voltage source, the multistate voltage source having an output voltage value responsive to a digital value encoded by an active and inactive state of the first and the second control signals.

13. A method of controlling a field emission device comprising:

dividing an 8-bit video word into a most significant nibble and a least significant nibble;

converting the most significant nibble into a first signal having a first active time responsive to a value of the most significant nibble;

converting the least significant nibble into a second signal having a second active time responsive to a value of the least significant nibble; and applying the first signal to a first input of a multistate voltage source while applying the second signal to a second input of the multistate voltage source, the multistage voltage source having a voltage output responsive to both the first signal and the second signal.

14. The method of claim 13 wherein having the voltage output responsive to both the first signal and the second signal includes having a voltage output value responsive to the first signal and the second signal, and a voltage output duration responsive to both the first active time and the second active time.

15. The method of claim 14 wherein having the voltage output value responsive to the first signal and the second signal includes having the voltage output value responsive to a digital word encoded by an active and inactive state of the first signal and the second signal.

16. The method of claim 13 wherein having the voltage output responsive to both the first signal and the second signal includes having the voltage output at a zero value when the first signal and the second signal are not active, a first value when the first signal and the second signal are active, a second value when the first signal is active and the second signal is not active, and a third value when the first signal is not active and the second signal is active.

17. A method of controlling an electron source comprising;

receiving a digital control word;

dividing the control word into a plurality of digital subwords;

converting each subword into a control signal thereby forming a plurality of control signals, each control signal having an active time; and utilizing the plurality of control signals to control a drive signal applied to the electron source wherein an active time of the drive signal and a value of the drive signal are responsive to the plurality of control signals.

18. A method of controlling an electron source comprising:

receiving a digital control word:

dividing the control word into a plurality of digital subwords;

converting each subword into a control signal thereby forming a plurality of control signals, each control signal having an active time: and utilizing the plurality of control signals to control a drive signal applied to the electron source by using an active and inactive state of the plurality of control signals to encode the value of the drive signal wherein an active time of the drive signal and a value of the drive signal are responsive to the plurality of control signals.

19. The method of claim 18 wherein utilizing the plurality of control signals to control the drive signal includes utilizing a value of a first digital subword of the plurality of digital subwords to determine an active time of a first control signal, and a value of a second digital subword of the plurality of digital subwords to determine an active time of a second control signal.

20. The method of claim 18 wherein utilizing the plurality of control signals to control the drive signal includes applying each control signal to a multistate voltage source to control both an output voltage value of the multistate voltage source and an active time of the output voltage value.

* * * * *